US008702385B2

(12) United States Patent
Burdgick et al.

(10) Patent No.: US 8,702,385 B2
(45) Date of Patent: Apr. 22, 2014

(54) WELDED NOZZLE ASSEMBLY FOR A STEAM TURBINE AND ASSEMBLY FIXTURES

(75) Inventors: Steven Sebastion Burdgick, Guilderland, NY (US); Thomas Patrick Russo, Galway, NY (US)

(73) Assignee: General Electric Company, Schenectady, NY (US)

( * ) Notice: Subject to any disclaimer, the term of this patent is extended or adjusted under 35 U.S.C. 154(b) by 573 days.

(21) Appl. No.: 13/106,328

(22) Filed: May 12, 2011

(65) Prior Publication Data

US 2011/0211946 A1 Sep. 1, 2011

Related U.S. Application Data

(63) Continuation-in-part of application No. 11/892,716, filed on Aug. 27, 2007, now Pat. No. 7,997,860, which is a continuation-in-part of application No. 11/331,024, filed on Jan. 13, 2006, now Pat. No. 7,427,187.

(51) Int. Cl.

| | |
|---|---|
| ***F01D 1/02*** | (2006.01) |
| ***F01D 9/02*** | (2006.01) |
| ***F01D 9/04*** | (2006.01) |

(52) U.S. Cl.

CPC .. *F01D 1/02* (2013.01); *F01D 9/02* (2013.01); *F01D 9/042* (2013.01); *F01D 9/044* (2013.01); *F05D 2230/64* (2013.01); *F05D 2230/232* (2013.01); *F05D 2260/36* (2013.01)

USPC ..... 415/191; 415/209.3; 415/209.4; 415/210.1; 29/889.22

(58) Field of Classification Search

CPC ..... F01D 1/02; F01D 9/02; F01D 9/042; F01D 9/044; F05D 2230/232; F05D 2230/64; F05D 2260/36

USPC ..... 415/191, 209.3, 209.4, 210.1; 29/889.22

See application file for complete search history.

(56) References Cited

U.S. PATENT DOCUMENTS

| | | | |
|---|---|---|---|
| 1,740,800 | A | 12/1929 | Anton |
| 1,998,951 | A | 4/1935 | Downer |
| 2,245,237 | A | 6/1941 | Truex |
| 2,654,566 | A | 10/1953 | Winnett et al. |
| 3,365,173 | A | 1/1968 | Lynch et al. |

(Continued)

FOREIGN PATENT DOCUMENTS

| | | | |
|---|---|---|---|
| RU | 2236338 | C2 | 9/2004 |
| SU | 831497 | A1 | 5/1981 |

OTHER PUBLICATIONS

Notice of Allowance from RU Application No. 2008134949 dated Oct. 18, 2012.

*Primary Examiner* — Igor Kershteyn

(74) *Attorney, Agent, or Firm* — Nixon & Vanderhye P.C.

(57) ABSTRACT

A nozzle blade and nozzle ring assembly includes a nozzle blade having radially inner and outer sidewalls with an airfoil portion extending therebetween; the inner and outer sidewalls walls formed with axially-extending first surface features along forward and aft marginal edges of the inner and outer sidewalls, respectively; and radially inner and outer nozzle rings formed with corresponding axially-extending second surface features mated with the first surface features, wherein the radially inner and outer sidewalls are welded to the radially inner and outer nozzle rings only along the mated first and second surface features.

20 Claims, 10 Drawing Sheets

(56) References Cited

U.S. PATENT DOCUMENTS

| | | | | | |
|---|---|---|---|---|---|
| 3,501,246 | A | * | 3/1970 | Hickey | 415/174.2 |
| 3,788,767 | A | | 1/1974 | Bednarczyk et al. | |
| 3,849,023 | A | | 11/1974 | Klompas | |
| 4,128,929 | A | | 12/1978 | DeMusis | |
| 4,265,595 | A | | 5/1981 | Bucy et al. | |
| 4,710,097 | A | | 12/1987 | Tinti | |
| 4,889,470 | A | | 12/1989 | Scalzo | |
| 5,022,818 | A | * | 6/1991 | Scalzo | 415/209.3 |
| 5,024,579 | A | * | 6/1991 | Groenendaal et al. | 415/108 |
| 5,249,918 | A | * | 10/1993 | Knorowski | 415/108 |
| 5,259,727 | A | * | 11/1993 | Quinn | 415/190 |
| 5,343,694 | A | | 9/1994 | Toborg et al. | |
| 5,586,864 | A | | 12/1996 | Knorowski et al. | |
| 5,593,273 | A | | 1/1997 | Brinkman | |
| 5,743,711 | A | | 4/1998 | Fournier et al. | |
| 5,788,456 | A | | 8/1998 | Maier | |
| 5,807,074 | A | | 9/1998 | Fournier et al. | |
| 6,068,541 | A | | 5/2000 | Dwyer | |
| 6,196,793 | B1 | | 3/2001 | Braaten | |
| 6,302,648 | B1 | * | 10/2001 | Konishi et al. | 415/193 |
| 6,435,825 | B1 | | 8/2002 | Kirby, III et al. | |
| 6,705,829 | B1 | | 3/2004 | Brown et al. | |
| 6,754,956 | B1 | | 6/2004 | Tomko et al. | |
| 6,888,090 | B2 | | 5/2005 | Murphy | |
| 2004/0253095 | A1 | | 12/2004 | Sasaki et al. | |

* cited by examiner

WELDED NOZZLE ASSEMBLY FOR A STEAM TURBINE AND ASSEMBLY FIXTURES

This is a continuation-in-part of application Ser. No. 11/892,716 filed Aug. 27, 2007 which, in turn, is a continuation-in-part of application Ser. No. 11/331,024, filed Jan. 13, 2006.

The present invention generally relates to nozzle assemblies for steam turbines and particularly relates to a welded nozzle assembly and fixtures facilitating alignment and manufacture of the nozzle.

BACKGROUND OF THE INVENTION

Steam turbines typically comprise static nozzle segments that direct the flow of steam into rotating buckets that are connected to a rotor. In steam turbines, a row of nozzles, each nozzle including an airfoil or blade construction, is typically called a diaphragm stage. Conventional diaphragm stages are constructed principally using one of two methods. A first method uses a band/ring construction wherein the airfoils are first welded between inner and outer bands extending about 180°. Those arcuate bands with welded airfoils are then assembled, i.e., welded between the inner and outer rings of the stator of the turbine. The second method often consists of airfoils welded directly to inner and outer rings using a fillet weld at the ring interfaces. The latter method is typically used for larger airfoils where access for creating the weld is available.

There are inherent limitations using the first-mentioned band/ring method of assembly. A principle limitation in the band/ring assembly method is the inherent weld distortion of the flowpath, i.e., between adjacent blades and the steam path sidewalls. The weld used for these assemblies is of considerable size and heat input. That is, the weld requires high heat input using a significant quantity of metal filler. Alternatively, the welds are very deep electron beam welds (EBWs) without filler metal. This material or heat input causes the flow path to distort e.g., material shrinkage causes the airfoils to bow out of their designed shaped in the flow path. In many cases, the airfoils require adjustment after welding and stress relief. The result of this steam path distortion is reduced stator efficiency. The surface profiles of the inner and outer bands can also change as a result of welding the nozzles into the stator assembly further causing an irregular flow path. The nozzles and bands thus generally bend and distort. This requires substantial finishing of the nozzle configuration to bring it into design criteria. In many cases, approximately 30% of the costs of the overall construction of the nozzle assembly is in the deformation of the nozzle assembly, after welding and stress relief, back to its design configuration.

Also, methods of assembly using single nozzle construction welded into rings do not have determined weld depth, lack assembly alignment features on both the inner and outer ring and also lack retainment features in the event of a weld failure. Further, current nozzle assemblies and designs do not have common features between nozzle sizes that enable repeatable fixturing processes. That is, the nozzle assemblies do not have a feature common to all nozzle sizes for reference by machine control tools and without that feature, each nozzle assembly size requires specific setup, preprocessing, and specific tooling with consequent increase costs. Accordingly, there has been demonstrated a need for an improved steam flowpath for a stator nozzle which includes low input heat welds to minimize or eliminate steam path distortion resultant from welding processes as well as to improve production and cycle costs by adding features that assist in assembly procedures, machining fixturing, facilitate alignment of the nozzle assembly in the stator and create a mechanical lock to prevent downstream movement of the nozzle assembly in the event of a weld failure.

BRIEF SUMMARY OF THE INVENTION

In accordance with one exemplary non-limiting embodiment, the invention relates to a nozzle blade and nozzle ring assembly comprising a nozzle blade having radially inner and outer sidewalls with an airfoil portion extending therebetween; the inner and outer sidewalls walls formed with axially-extending first surface features along forward and aft marginal edges of the inner and outer sidewalls, respectively; and radially inner and outer nozzle rings formed with corresponding axially-extending second surface features mated with the first surface features, wherein the radially inner and outer sidewalls are welded to the radially inner and outer nozzle rings only along the mated first and second surface features.

In another non-limiting aspect the invention relates to a nozzle blade and nozzle ring assembly comprising a nozzle blade having radially inner and outer sidewalls with an airfoil portion extending therebetween; the inner and outer sidewalls walls each formed with first forward and aft marginal edges; and radially inner and outer nozzle rings each formed with second forward and aft marginal edges, the radially inner and outer sidewalls welded to the radially inner and outer nozzle rings only along the first forward and aft marginal edges and the second forward and aft marginal edges.

In still another aspect, the invention provides a method of attaching a nozzle assembly including at least one airfoil extending between inner and outer bands to inner and outer rings comprising forming first surface features along axially-spaced marginal fore and aft edges of each of the inner and outer bands; forming second surface features on the inner and outer rings that mate with the first features; and welding the inner and outer bands to the inner and outer rings only along the fore and aft marginal edges of the inner and outer bands.

DETAILED DESCRIPTION OF THE INVENTION

Figure 1:
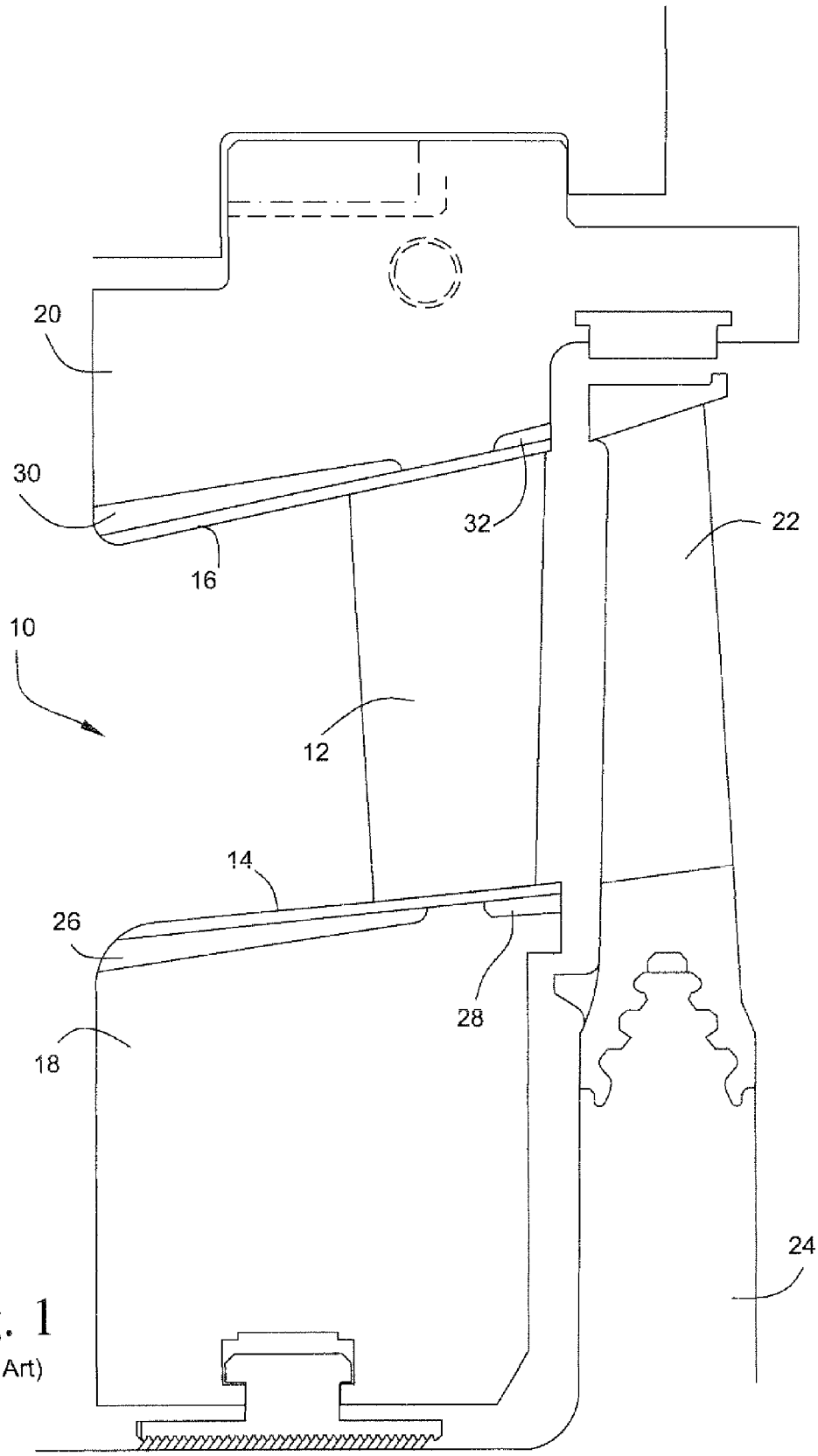
Fig. 1 (Prior Art)
FIG. 1 is a schematic line drawing illustrating a cross-section through a diaphragm stage of the steam turbine nozzle according to the prior art.

Referring to FIG. 1, there is illustrated a prior art nozzle assembly generally designated 10. Assembly 10 includes a plurality of circumferentially spaced airfoils or blades 12 welded at opposite ends between inner and outer bands 14 and 16, respectively. The inner and outer bands are welded between inner and outer rings 18 and 20, respectively. Also illustrated is a plurality of buckets 22 mounted on a rotor 24. It will be appreciated that nozzle assembly 10 in conjunction with the buckets 22 form a stage of a steam turbine.

Still referring to FIG. 1, the airfoils 12 are individually welded in generally correspondingly shaped holes, not shown, in the inner and outer bands 14 and 16 respectively. The inner and outer bands 14 and 16 typically extend in segments each of about 180 degrees. After the airfoils are welded between the inner and outer bands, this subassembly is then welded between the inner and outer rings 18 and 20 using very high heat input and deep welds. For example, the inner band 14 is welded to the inner ring 18 by a weld 26 which uses a significant quantity of metal filler, or which requires a very deep electron beam weld. Additionally, the backside, i.e., downstream side, of the weld between the inner band and inner ring requires a further weld 28 of high heat input. Similarly, high heat input welds 30, 32 including substantial quantities of metal filler or very deep electron beam welds are required to weld the outer band 16 to the outer ring 20 at opposite axial locations as illustrated. Thus, when the airfoils 12 are initially welded to the inner and outer bands 14, 16 and subsequently welded to the inner and outer rings 18 and 20, those large welds cause substantial distortion of the flowpath as a result of the high heat input and shrinking of the metal material and which causes the airfoils to deform from their design configuration. Also, the inner and outer bands 14, 16 may become irregular in shape from their designed shape, thus, further distorting the flowpath. As a result, the nozzle assemblies, after welding and stress relief, must be reformed back to their design configuration which, as noted previously, can result in 25-30% of the cost of the overall construction of the nozzle assembly. Lastly, if an EBW is used it may be used entirely from one direction going all the way to the opposing side (up to 4 inches thick).

There are also current singlet type nozzle assemblies which do not have a determinant weld depth and thus employ varying weld depths to weld the singlets into the nozzle assembly between the inner and outer rings. That is, weld depths can vary because the gap between the sidewalls of the nozzle singlet and rings is not consistent. As the gap becomes larger, due to machining tolerances, the weld depths and properties of the weld change. A tight weld gap may produce a shorter than desired weld. A larger weld gap may drive the weld or beam deeper and may cause voids in the weld that are undesirable. Current singlet nozzle designs also use weld prep at the interface and this requires an undesirable higher heat input filler weld technique to be used.

Figure 2:
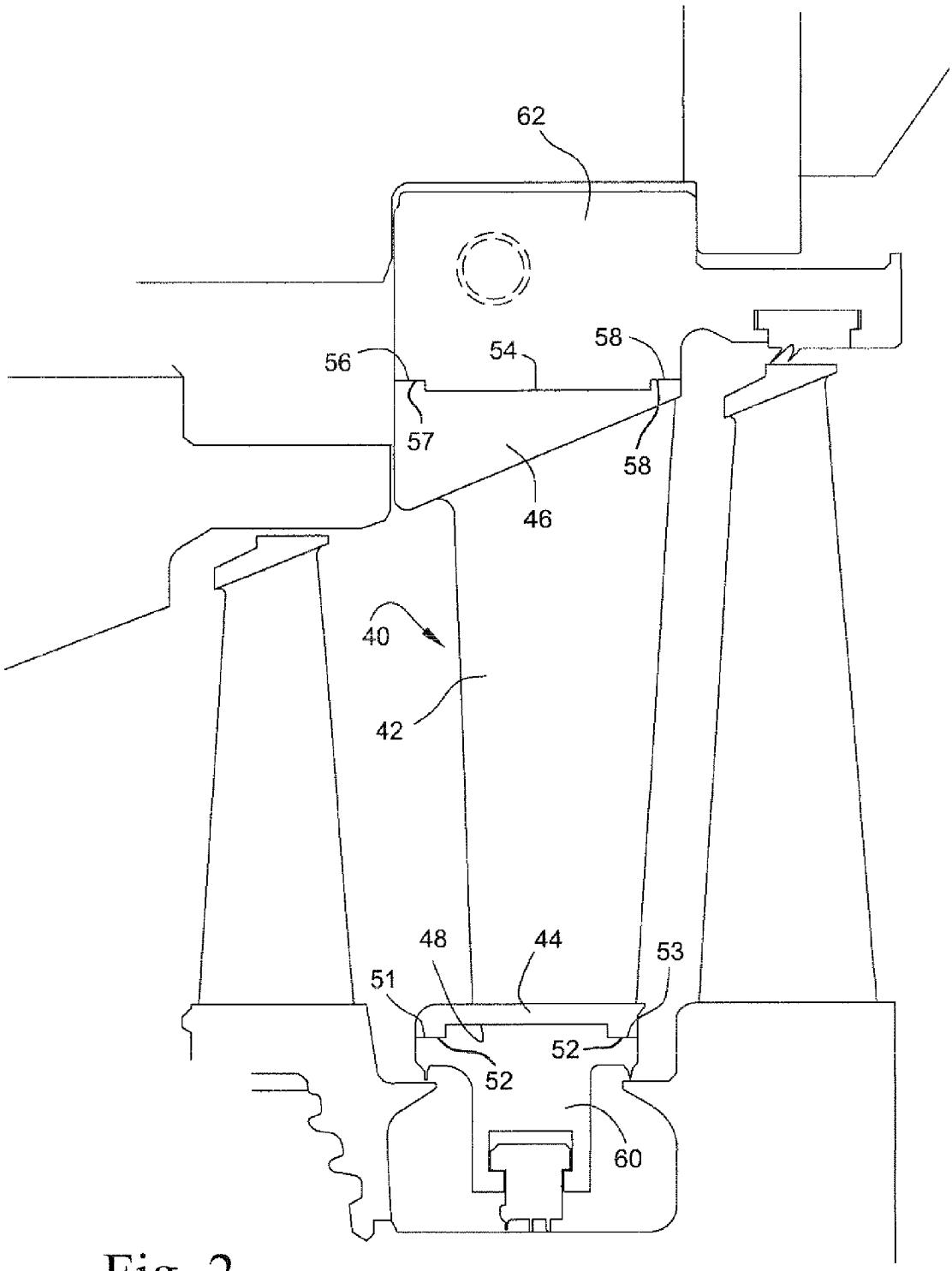
FIG. 2 is a line drawing of a steam turbine stage incorporating a nozzle assembly and weld features in accordance with a preferred embodiment of the present invention.

Referring now to FIG. 2, there is illustrated a preferred embodiment of a nozzle assembly according to the present invention which utilizes a singlet i.e., a single airfoil with sidewalls welded to inner and outer rings directly with a low heat input weld, which has mechanical features providing improved reliability and risk abatement due to a mechanical lock at the interface between the nozzle assembly and inner and outer rings as well as alignment features. Particularly, the nozzle assembly in a preferred embodiment hereof, includes integrally formed singlet subassemblies generally designated 40. Each subassembly 40 includes a single airfoil or blade 42 between inner and outer sidewalls or bands 44 and 46, respectively, the blade and sidewalls being machined from a near net forging or a block of material. As illustrated, the inner sidewall 44 includes a female recess 48 flanked or straddled by radially inwardly projecting male steps or flanges 50 and 52 along the leading and trailing (or forward and aft) marginal edges of the inner sidewall 44. Alternatively, the inner sidewall 44 may be constructed to provide a central male projection flanked by radially outwardly extending female recesses adjacent the leading and trailing marginal edges of the inner sidewall. Similarly, the outer sidewall 46, as illustrated, includes a female recess 54 flanked or straddled by a pair of radially outwardly extending male steps or flanges 56, 58 along the leading and trailing marginal edges of the outer sidewall 46. Alternatively, the outer sidewall 46 may have a central male projection flanked by radially inwardly extending female recesses along leading and trailing marginal edges of the outer sidewall.

The nozzle singlets 40 are then assembled between the inner and outer nozzle rings 60 and 62, respectively, using a low heat input type weld. For example, the low heat input type weld uses a butt weld interface and preferably employs a shallow electron beam weld or shallow laser weld or a shallow flux-TIG or A-TIG weld process. By using these weld processes and types of welds, the welds may be limited to the interfaces between the sidewalls 44, 46 and rings 60, 62 and specifically along the mechanical interface between steps 50, 52, 56 and 58 of the sidewalls and corresponding complimentary recesses 51, 53, 55 and 57 in the rings 60, 62 as best seen in FIG. 2. Thus, the welding occurs for only a short axial distance, preferably not exceeding the axial extent of the steps 50, 52, 56 and 58, along the opposite axially-spaced marginal edges of the sidewalls, and without the use of filler weld material. Particularly, less than ½ of the axial distance spanning the inner and outer sidewalls is used to weld the singlet nozzle between the inner and outer rings. For example, by using electron beam welding in an axial direction from both the leading and trailing sides of the interface between the sidewalls 44, 46 and the rings 60, 62, the axial extent of the welds where the materials of the sidewalls and rings coalesce is less than ½ of the full extent of the axial interface (or axial lengths of the respective inner and outer sidewalls). As noted previously, if an EBW weld is used, the weld may extend throughout the full axial extent of the registration of the sidewalls and the rings.

This step and recess configuration is used to control the weld depth and render it determinant and consistent between nozzle singlets during production. This interlock is also used to axially align the nozzle singlets between the inner and outer rings. The interlock holds the nozzles in position during the assembly of the nozzle singlets between the inner and outer rings and the welding. That is, the nozzle singlets can be packed tightly adjacent one another and between the inner and outer rings while remaining constrained by the rings. Further, the mechanical interlock retains the singlets in axial position during steam turbine operation in the event of a weld failure, i.e., prevents the singlet from moving downstream into contact with the rotor.

Figure 4:
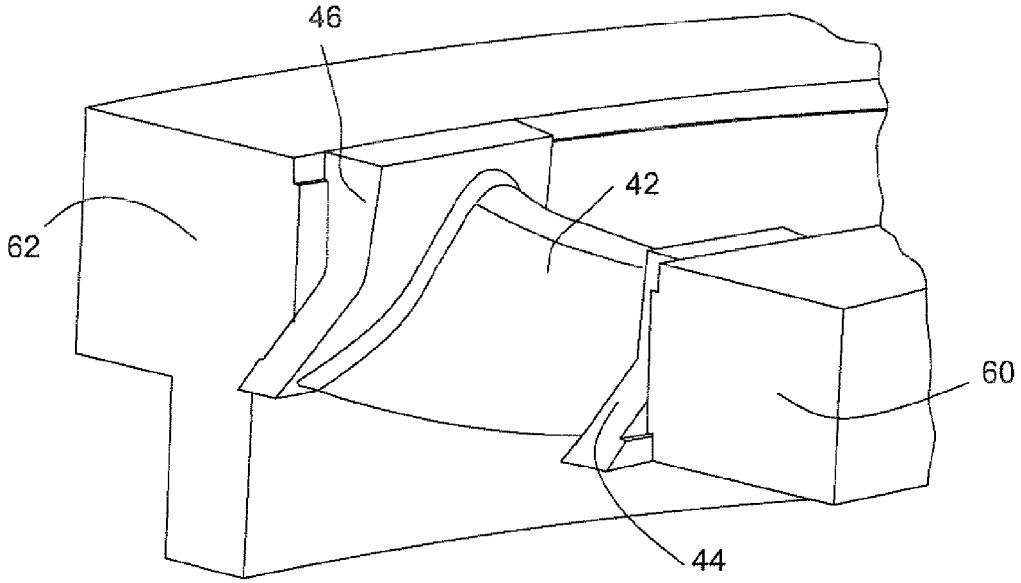
FIG. 4 is a schematic illustration of an assembly of the singlet nozzle of FIG. 3 between the inner and outer rings of the stator.

A method of assembly is best illustrated in FIG. 4 where the assembly process illustrated includes disposing a singlet 40 between the inner and outer rings 60, 62 when the rings and singlets are in a horizontal orientation. Thus, by rotating this assembly circumferentially relative to a fixed e-beam welder or vice versa, and then inverting the assembly and completing the weld from the opposite axial direction, the nozzle assemblies are welded to the inner and outer rings in a circumferential array thereof without high heat input or the use of filler material.

Figure 5:
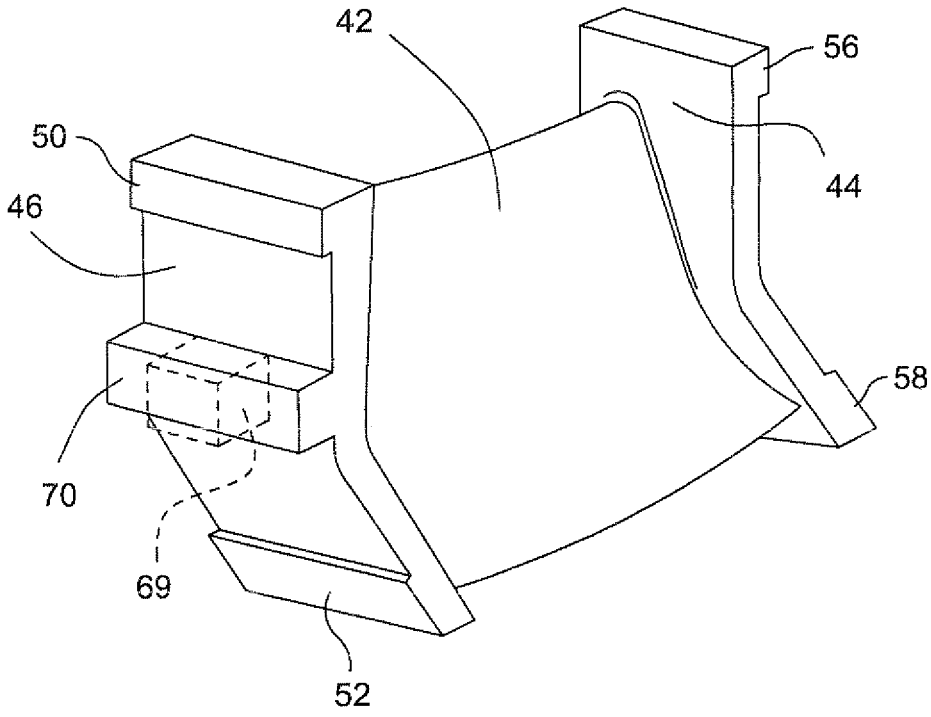
FIGS. 5 and 6 are enlarged perspective views of singlet nozzles incorporating alignment and reference features.
Figure 6:
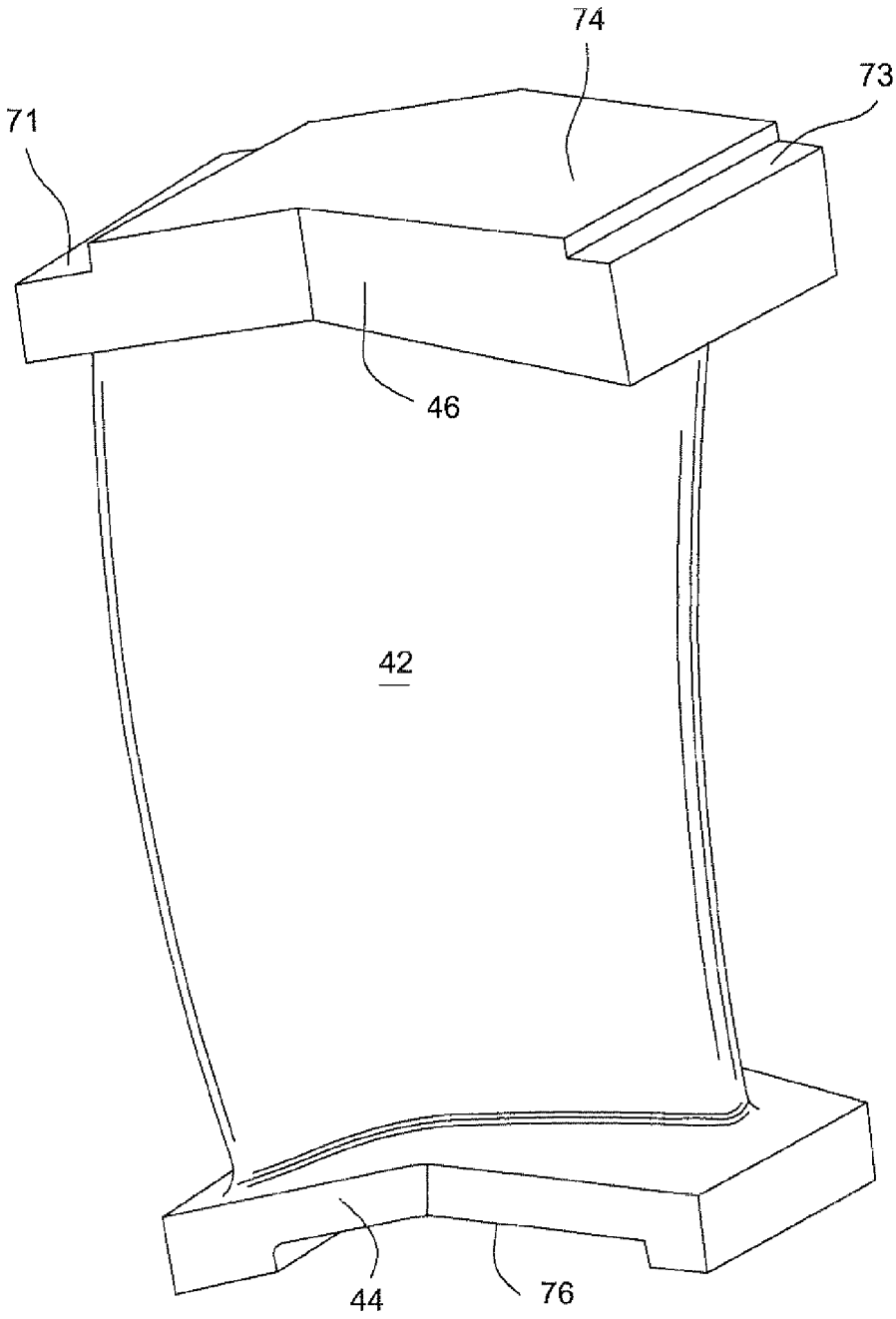
Figure 7:
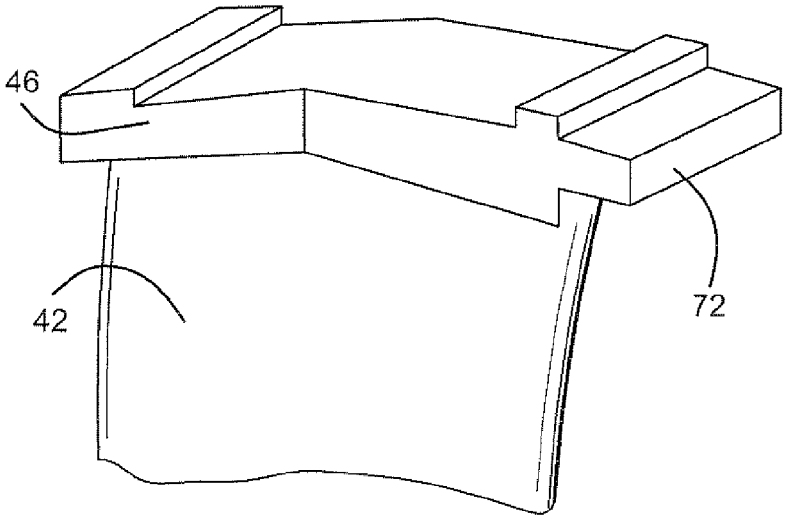
FIGS. 7 and 8 show partial perspective views of a nozzle assembly illustrating further embodiments of the alignment and reference features hereof.

Referring particularly to FIGS. 5, 6 and 7 there are further illustrated features added to the singlet design that assists with fixturing the nozzle singlet while it undergoes milling machine processes. These features are added to the nozzle singlet design to give a consistent interface to the machining singlet supplier. For example, in FIG. 5, one of those features includes a rib or a rail 70 on the top or bottom sidewall. As an alternative to the elongated rectangular rail 70, a substantially cube-shaped lug 69 could be employed as a fixturing feature as shown in dashed lines in FIG. 5. The lug 69 may be substantially centered between the steps along the marginal edges of the sidewalls. Another fixturing feature is illustrated in FIG. 7 including a forwardly extending rib 72 along the outer sidewall 46. It will be appreciated that the rib 72 can be provided along the inner sidewall 44 and in both cases may be provided adjacent the trailing surfaces of those sidewalls. It will be appreciated that the shape of fixturing feature may vary with specific applications.

In FIG. 6, flats 74 may be provided on the outer surface of the outer sidewalls as well as flats 76 on the outer surface of the inner sidewall. Those flats 74 and serve as machining datum to facilitate fixturing during machining processes. Current designs have a radial surface which is more complex and costly to machine as well as difficult to fixture for component machining. Note also that the sidewall/ring interface at the outer sidewall 46 is substantially reversed relative to the arrangement in FIGS. 2 and 3. In other words, in FIG. 6, the weld areas extend along axially-oriented recesses 71, 73 formed in the outer sidewall 46 and corresponding recesses (not shown) in the outer ring. A similar reversal of steps/recesses could also be implemented at the inner sidewall/ring interface.

Figure 8:
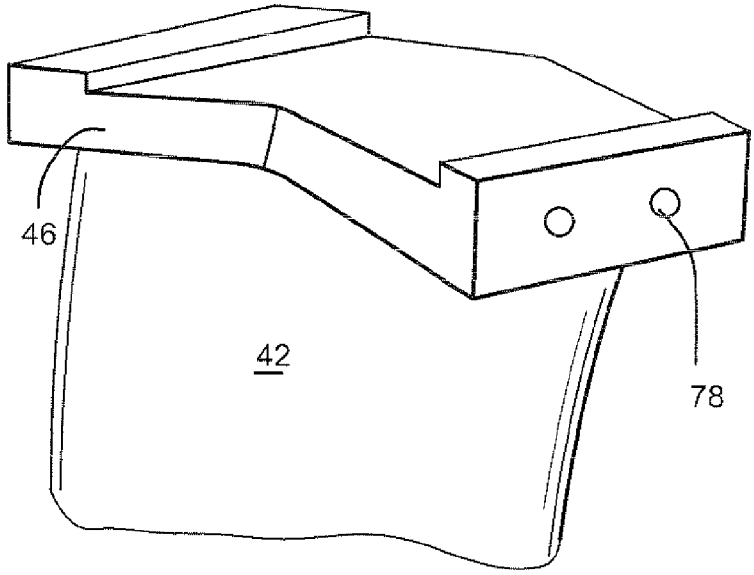

In FIG. 8, a pair of holes may be provided on the forward or aft outer sidewalls or on the forward or aft inner sidewalls. Those holes can be picked up consistently by the machining center between several nozzle designs and sizes to facilitate fixturing for machining purposes. Thus, by adding these features, a consistent interface to the machine supplier is provided which serves to reduce tooling, preprocessing, and machining cycle for the machining of the singlet. These fixturing features meet the need to provide a reference point so that the numerically controlled machining tool can identify the location of a feature common to all nozzles. For example, the two holes 78 illustrated in FIG. 8, provides two points on a fixture and establishes two planes which controls the entire attitude of the nozzle during machining enabling the machine to form any size of integral nozzle singlet.

Figure 3:
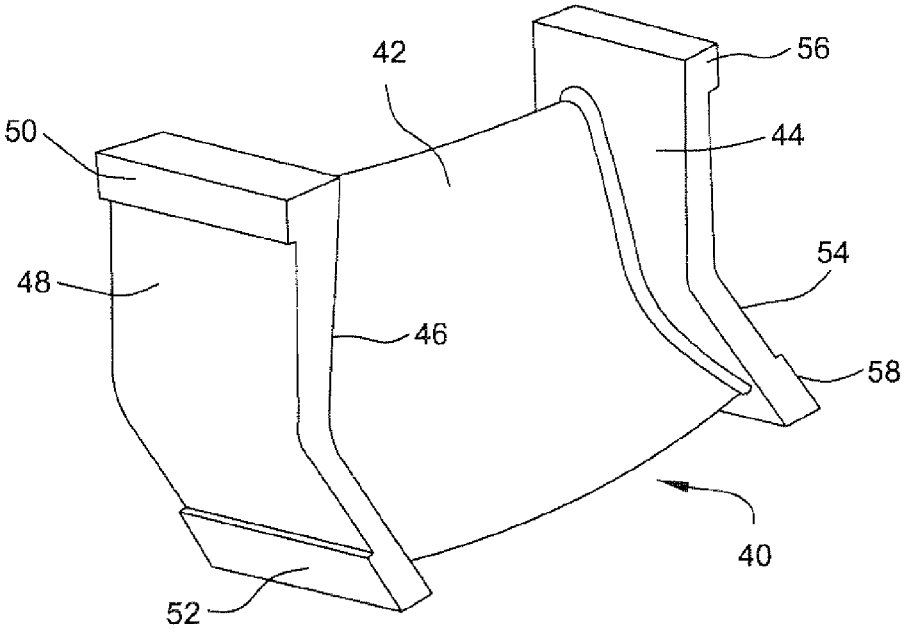
FIG. 3 is a perspective view of a singlet nozzle assembly.

In the arrangements shown in FIGS. 5, 7 and 8, the weld surfaces remain as previously described in connection with FIGS. 2, 3 and 6, i.e., along the mated axially-extending steps and recesses (or vice versa) formed in the inner and outer sidewalls and rings, respectively.

Figure 9:
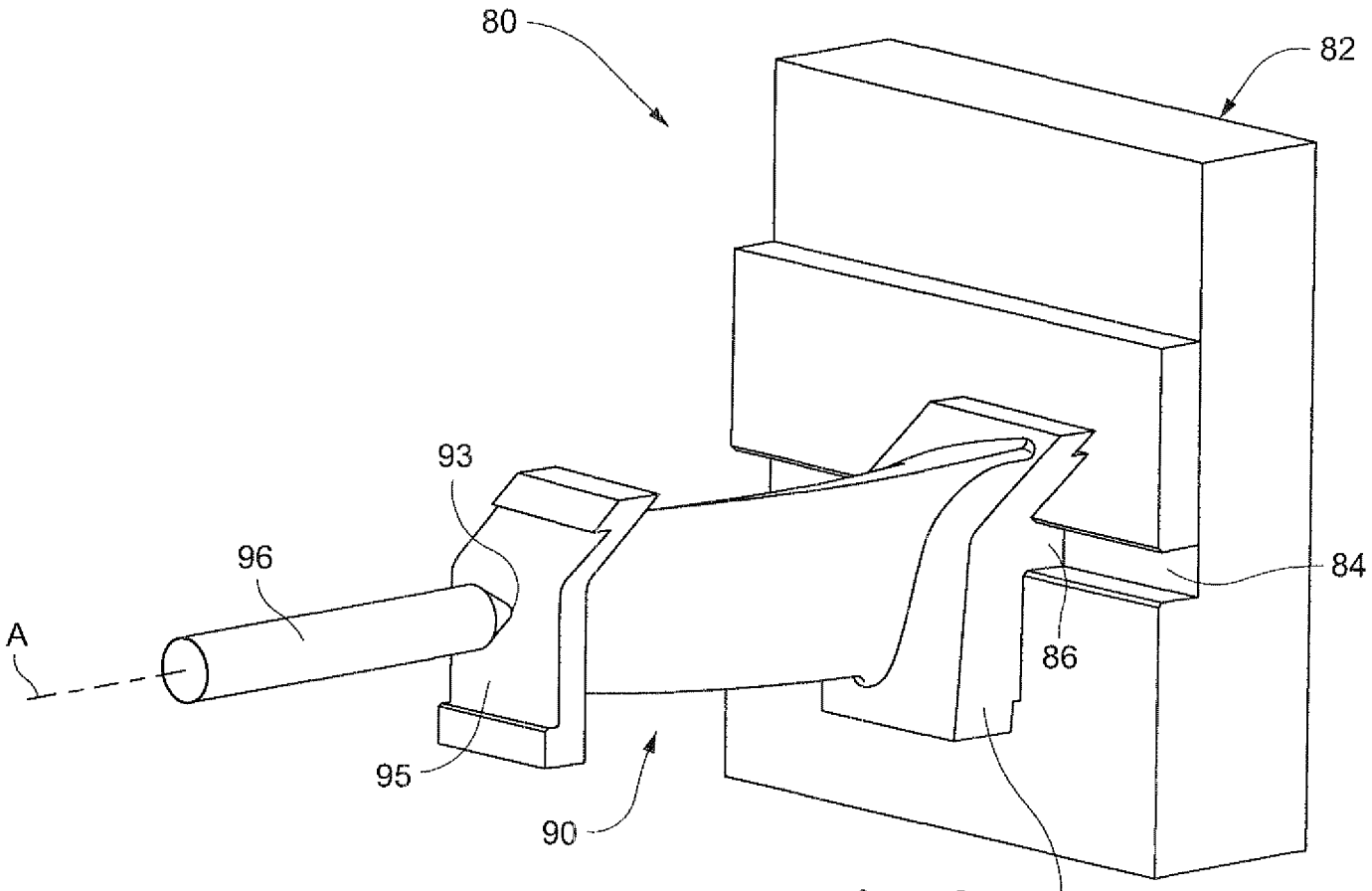
FIG. 9 is a perspective view of a singlet nozzle held in a jig for machining.
Figure 10:
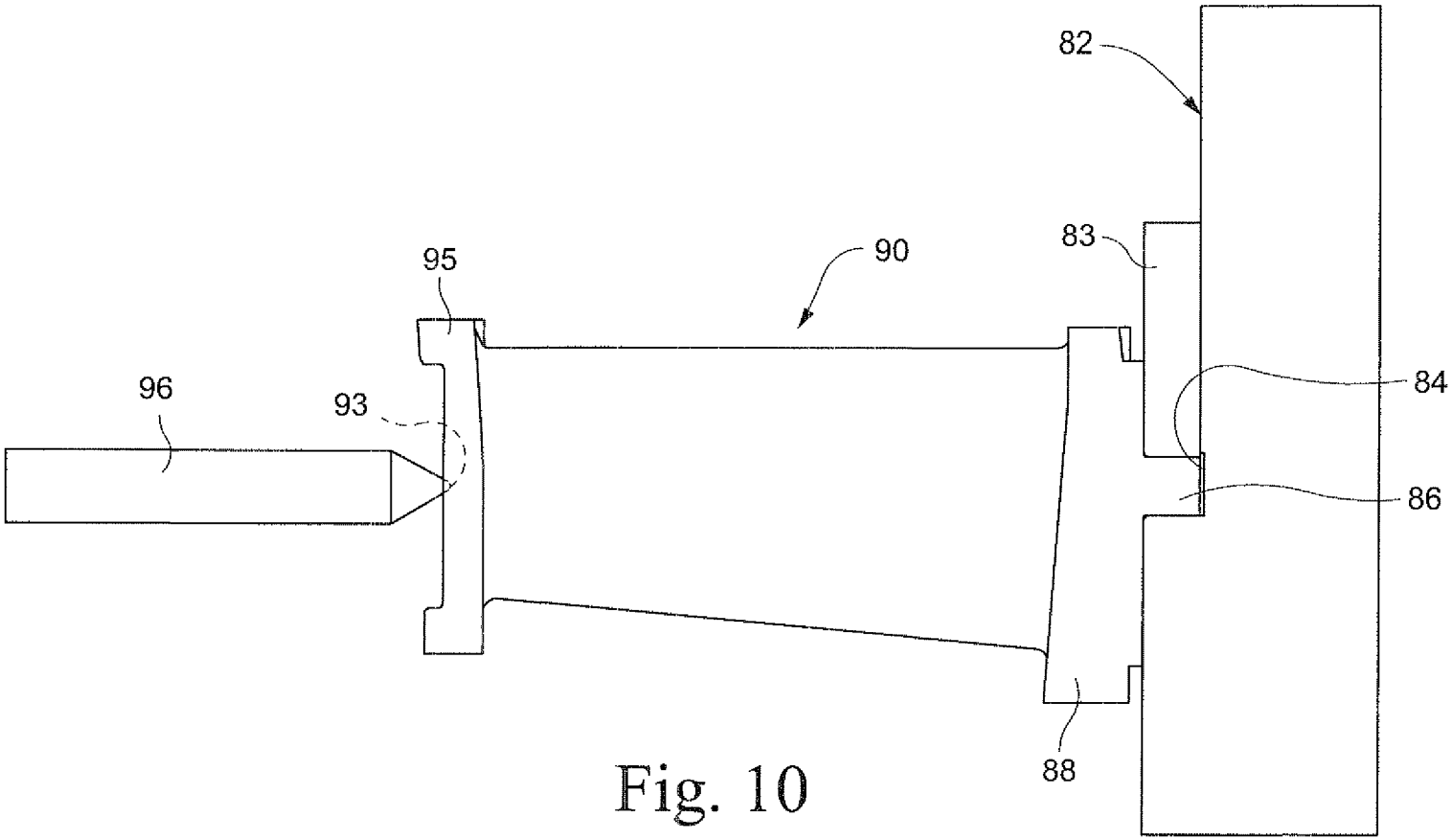
FIG. 10 is a side elevation of the nozzle and jig of FIG. 9.
Figure 11:
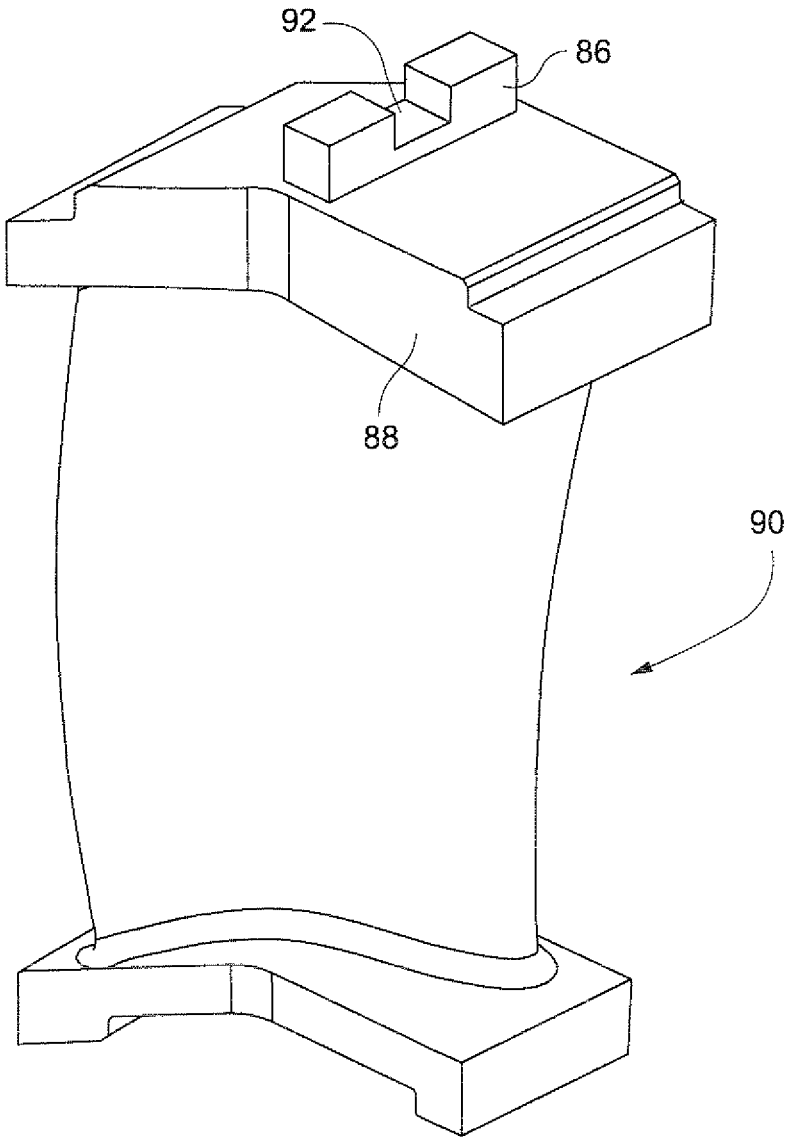
FIG. 11 is a perspective view of the singlet nozzle shown in FIGS. 9 and 10.
Figure 12:
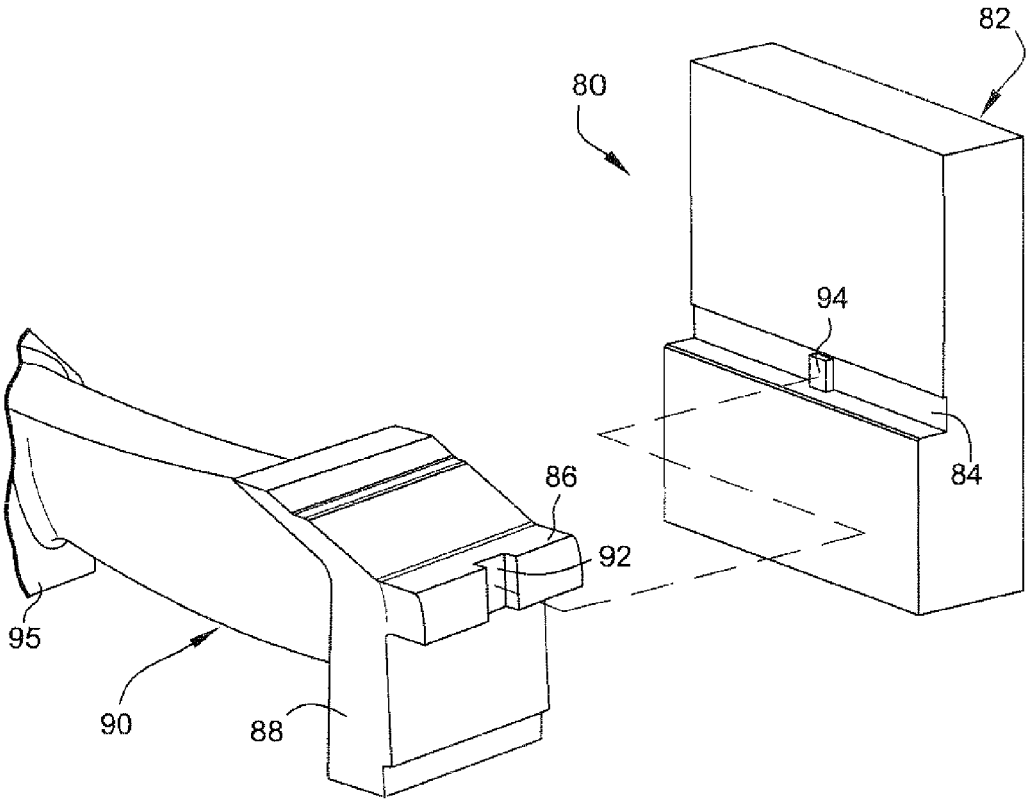
FIG. 12 is an exploded view of the nozzle and jig arrangement shown in FIGS. 9 and 10.

Turning now to FIGS. 9, 10 and 12, a jig assembly 80 is shown to include a machining fixture 82 mounted on a table (not shown) that is rotatable about a machine center axis A. The fixture 82 is provided with a slot 84 (or alignment feature) that receives another alignment feature in the form of a top rail or ridge 86 (similar to rail 70 in FIG. 5) extending across the inner sidewall 88 of the singlet 90. Note that a wall portion 83 (omitted in FIG. 12) of the fixture 82 may be slidably mounted to facilitate clamping of the nozzle rail 86 within the slot 84. Thus, the lower surface of the slidable wall 83 defines the upper surface of the slot 84. As best seen in FIG. 11, a notch 92 is formed in the center of rail 86. The notch 92 is adapted to engage a tab 94 provided in the slot 84. The top rail 86 and slot 84 intersect the machine center axis A, and the notch 92 and tab 94 serve to align the center of the airfoil portion of the nozzle with the axis A, and to also prevent lateral movement of the singlet. A support rod 96, lying on the center axis A, is engaged within a recess 93 formed in the outer sidewall 95 of the singlet nozzle 90 during machining. In this regard, the jig assembly 80 rotates the singlet nozzle 90 about axis A, relative to a tool (not shown) that machines the airfoil to its final specifications.

Note that using the same width and thickness for rails on various nozzles, and by having the rails pass through or cross the machine center, the respective alignment features permit universal application of the fixture 82 to all nozzle designs provided with an appropriately located top rail and notch as described above.

It will be appreciated that the fixturing rail 86 (or rail 70 or lug 69) on each nozzle singlet can remain on the singlet or be removed from the singlet after machining of the airfoil is completed. If the rail remains, it may be received in an appropriately sized groove in the inner or outer ring.

Figure 13:
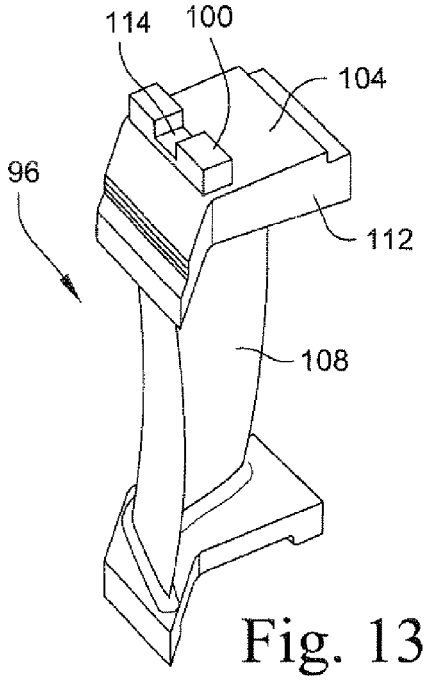
FIGS. 13 and 14 are perspective views of a singlet nozzles illustrating alignment and reference features in accordance with other exemplary embodiments.
Figure 14:
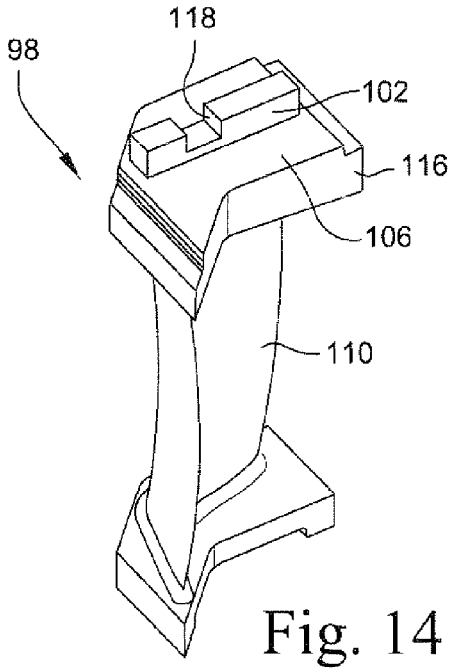

FIGS. 13 and 14 illustrate nozzles 96, 98, respectively, that are similar to those shown in FIGS. 9-12, but the respective rails 100, 102 are reoriented relative to the respective outer sidewalls 104, 106 and airfoils 108, 110 due to nozzle design differences. For example, in FIG. 13, the rail 100 extends perpendicular to the sidewall edge 112 of the outer ring, and notch 114 is centered along the rail 100. In FIG. 14, the rail 102 extends parallel to the sidewall edge 116, and the notch 118 is asymmetrically located along the length of the rail. In all cases, however, the rail passes through the center of the airfoil portion and, with the tab/notch arrangement, may be used with the same fixture 82 to align the singlet with the machine center axis A for machining the airfoil.

It will be appreciated that the location of the fixturing features as described above in connection with the inner and outer walls may be reversed, and that the tab and notch arrangement may have other suitable shapes that perform the desired alignment function.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle blade and nozzle ring assembly comprising:

a nozzle blade having radially inner and outer sidewalls with an airfoil portion extending therebetween; said inner and outer sidewalls walls formed with axially-extending first surface features along forward and aft marginal edges of said inner and outer sidewalls, respectively; and radially inner and outer nozzle rings formed with corresponding axially-extending second surface features mated with said first surface features, wherein said radially inner and outer sidewalls are welded to said radially inner and outer nozzle rings only along said mated first and second surface features.

2. The nozzle blade and nozzle ring assembly of claim 1 wherein said first surface features comprise radially inwardly directed flanges on said inner sidewall and radially outwardly directed flanges on said outer sidewall.

3. The nozzle blade and nozzle ring assembly of claim 2 wherein said second surface features comprise recesses in which said radially inwardly directed flanges and said radially outwardly directed flanges are received.

4. The nozzle blade and nozzle ring assembly of claim 1 wherein said first surface features comprise radially outwardly facing recesses on said outer sidewall and radially inwardly facing recesses on said inner sidewall.

5. The nozzle blade and nozzle ring assembly of claim 4 wherein said second surface features comprise flanges received in said radially outwardly facing recesses and said radially inwardly facing recesses.

6. The nozzle blade and nozzle ring assembly of claim 1 wherein said first surface features comprise radially outwardly facing recesses on said outer sidewall and radially inwardly directed flanges on said inner sidewall.

7. The nozzle blade and nozzle ring assembly of claim 6 wherein said second surface features comprise flanges received in said radially outwardly facing recesses and recesses receiving said radially inwardly directed flanges.

8. The nozzle blade and nozzle ring assembly of claim 1 wherein at least one of said inner and outer sidewalls is provided with an alignment surface feature between said marginal edges.

9. The nozzle blade and nozzle ring assembly of claim 8 wherein said alignment surface feature comprises a rail or rib extending substantially parallel to said marginal edges.

10. The nozzle blade and nozzle ring assembly of claim of claim 9 wherein said rail or rib is formed with a notch located between opposite ends of said rail or rib.

11. The nozzle blade and nozzle ring assembly of claim 10 wherein said notch is substantially centered along said rail.

12. The nozzle blade and nozzle ring assembly of claim 8 wherein said alignment surface feature comprises a lug located between said marginal edges of at least one of said inner and outer sidewalls.

13. The nozzle blade and nozzle ring assembly of claim 1 wherein said marginal edges comprise less than ½ an axial length dimension of said inner and outer sidewalls.

14. A nozzle blade and nozzle ring assembly comprising:

a nozzle blade having radially inner and outer sidewalls with an airfoil portion extending therebetween; said inner and outer sidewalls walls formed with first forward and aft marginal edges; and radially inner and outer nozzle rings formed with second forward and aft marginal edges, said radially inner and outer sidewalls welded to said radially inner and outer nozzle rings only along said first forward and aft marginal edges and second forward and aft marginal edges.

15. The nozzle blade and nozzle ring assembly of claim 14 wherein said marginal edges comprise less than ½ an axial length dimension of said inner and outer sidewalls.

16. A method of attaching a nozzle assembly including at least one airfoil extending between inner and outer bands to inner and outer rings comprising:

forming first surface features along axially-spaced marginal fore and aft edges of each of said inner and outer bands;

forming second surface features on said inner and outer rings that mate with said first features; and welding said inner and outer bands to said inner and outer rings only along said fore and aft marginal edges of said inner and outer bands.

17. The method of claim 16 wherein welding occurs along less than ½ axial length dimensions of and outer bands.

18. The method of claim 17 wherein said first surface features comprise radially inwardly directed flanges on said inner band and radially outwardly directed flanges on said outer band.

19. The method of claim 18 wherein said second surface features comprise recesses in which said radially inwardly directed flanges and said radially outwardly directed flanges are received.

20. The method of claim 16 wherein said first surface features comprise radially outwardly facing recesses on said outer band and radially inwardly facing recesses on said inner band.

* * * * *

UNITED STATES PATENT AND TRADEMARK OFFICE

CERTIFICATE OF CORRECTION

PATENT NO. : 8,702,385 B2
APPLICATION NO. : 13/106328
DATED : April 22, 2014
INVENTOR(S) : Burdgick et al.

It is certified that error appears in the above-identified patent and that said Letters Patent is hereby corrected as shown below:

In the Specification:

Column 3, lines 19-20, insert --two-- between “extend in” and “segments”

Column 5, line 25, insert --76-- after “flats 74 and”

In the Claims:

Claim 17, column 8, line 25, insert --said inner-- before “and outer bands”

Signed and Sealed this
Twenty-ninth Day of July, 2014

Michelle K. Lee

Michelle K. Lee
*Deputy Director of the United States Patent and Trademark Office*